US007022001B2

(12) United States Patent
Nakajima

(10) Patent No.: US 7,022,001 B2
(45) Date of Patent: Apr. 4, 2006

(54) POLISHING APPARATUS

(75) Inventor: Makoto Nakajima, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 11/033,884

(22) Filed: Jan. 13, 2005

(65) Prior Publication Data

US 2005/0159090 A1 Jul. 21, 2005

(30) Foreign Application Priority Data

Jan. 15, 2004 (JP) ..... 2004-008408

(51) Int. Cl.
*B24B 7/00* (2006.01)

(52) U.S. Cl. ..... 451/262; 451/259; 451/270; 451/271; 451/290; 451/291

(58) Field of Classification Search ..... 451/262, 451/259, 269, 270, 271, 272, 261, 264, 290, 451/291
See application file for complete search history.

(56) References Cited

U.S. PATENT DOCUMENTS 4,433,510 A * 2/1984 Katagiri et al. ..... 451/5
4,593,495 A * 6/1986 Kawakami et al. ..... 451/269
5,697,832 A * 12/1997 Greenlaw et al. ..... 451/291
6,030,278 A * 2/2000 Honda ..... 451/41
6,113,490 A * 9/2000 Hakomori ..... 451/288
6,250,997 B1 * 6/2001 Hatano et al. ..... 451/259

FOREIGN PATENT DOCUMENTS

JP 2000-127033 A 5/2000

* cited by examiner

*Primary Examiner*—George Nguyen
(74) *Attorney, Agent, or Firm*—Birch, Stewart, Kolasch & Birch, LLP

(57) ABSTRACT

The small polishing apparatus is capable of simultaneously polishing both side faces of a work piece, and a lower polishing plate, an internal gear and a sun gear are respectively driven by direct drive (DD) motors. The polishing apparatus comprises: an upper and a lower polishing plates; a sun gear and an internal gear; and a carrier provided between the polishing plates and engaged with the gears. Both side faces of the work piece held by the carrier are simultaneously polished by the polishing plates. DD motors respectively rotate the lower polishing plate and the gears. Each DD motor has a ring-shaped output member. A first DD motor has the output member directly connected to a rotary holding member rotatably holding the lower polishing plate. A second DD motor is provided under the first DD motor. One end of a rotary shaft, which is pierced through the first DD motor, is connected to a rotary holding member rotatably holding one of the gears, and the other end is directly connected to the output member of the second DD motor.

14 Claims, 6 Drawing Sheets

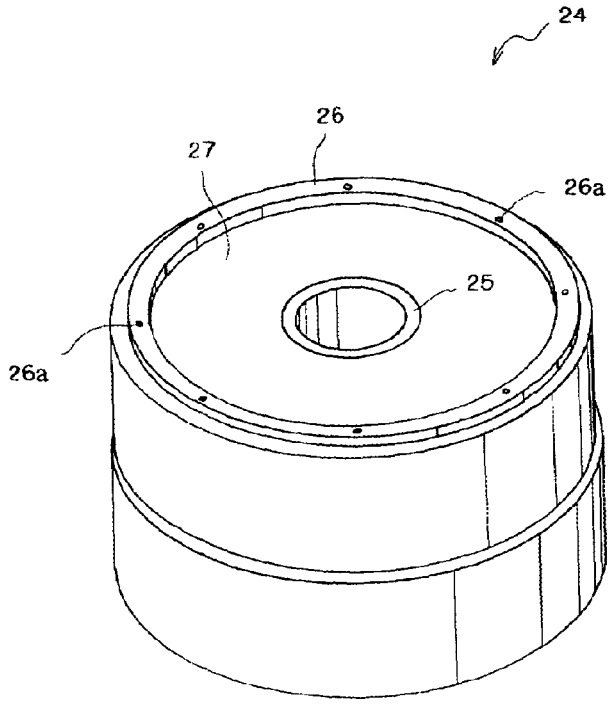
FIG.2
FIG.4A
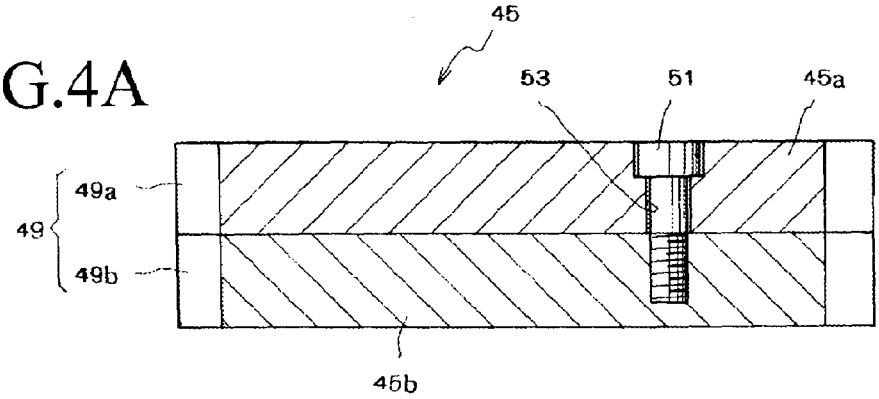
FIG.4B
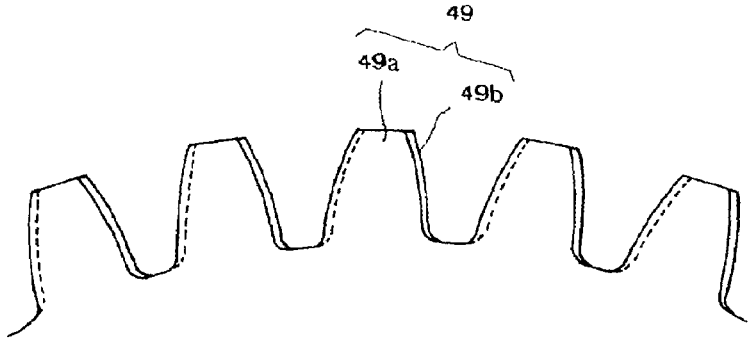

POLISHING APPARATUS

BACKGROUND OF THE INVENTION

The present invention relates to a polishing apparatus, more precisely relates to a polishing apparatus, which is capable of simultaneously polishing both side faces of a work piece held by a carrier engaging with a sun gear and an internal gear provided between an upper polishing plate and a lower polishing plate, with the polishing plates.

A conventional apparatus for simultaneously polishing both side faces of work pieces, e.g., silicon wafers, crystal plates, is shown in FIG. 6. In the apparatus shown in FIG. 6, carriers 208 driven by an internal gear 204 and a sun gear 206 are provided between a lower polishing plate 200 and an upper polishing plate 202 rotating in prescribed directions. Each of the carriers 208 has a plurality of through-holes for holding the work pieces, and the both side faces of the work pieces are simultaneously polished by the polishing plates 200 and 202.

The lower polishing plate 200 is mounted on a lower plate holder 209 and rotated together with the lower plate holder 209. The lower plate holder 209 is rotatably mounted on a base 210 with a bearing 212 and rotated by torque transmitted from an electric motor 214 via a gear 216 and a cylindrical shaft 217.

The upper polishing plate 202 is rotated by torque transmitted from an electric motor 224 via a gear 218 and a shaft 219. The internal gear 204 is rotated by torque transmitted from an electric motor 226 via a gear 220 and a cylindrical shaft 221. Further, the sun gear 206 is rotated by torque transmitted from an electric motor 228 via a gear 222 and a cylindrical shaft 223.

As shown in FIG. 7, a plurality of the carriers 208 are mounted on the lower polishing plate 200, and a plurality of through-holes 230, in each of which the work piece will be held, are formed in each carrier 208.

Further, gear teeth, which engage with the internal gear 204 and the sun gear 206, are formed on an outer circumferential face of each carrier 208. Therefore, when the gears 204 and 206 rotate, the carriers 208 are spun about their own axes and moved around the sun gear 206 by a rotational speed difference between the gears 204 and 206.

The work pieces are respectively held in the through-holes 230 of the carriers 208, the carriers 208 are provided between the polishing plates 200 and 202, and the polishing plates 200 and 202 and the gears 204 and 206 are rotated at prescribed rotational speeds. With this action, the work pieces are spun and moved round the sun gear 206 together with the carriers 208, and their both side faces are simultaneously polished by the polishing plates 200 and 202.

These days, work pieces become thinner and thinner. Thus, the carriers 208 and/or the work pieces held by the carriers 208 are easily damaged or broken while polishing.

One of reasons causing the damage or break is vibrations. In the polishing apparatus shown in FIG. 6, torques of the motors 214, 224, 226 and 228 are transmitted to the shafts via the gears 216, 218, 220 and 222, reduction gear units, etc. Namely, vibrations are easily generated between the gears, and the vibrations are apt to damage the work pieces held by the carriers 208.

Further, when the polishing operation starts, it is difficult to synchronize the motors 214, 224, 226 and 228 due to backlashes of the gears 216, 218, 220 and 222, and the reduction units. Overloads are applied to the carriers 208, so that the carriers 208 may be damaged or the work pieces may jump out.

To reduce the vibrations and backlashes of the gears, another polishing apparatus shown in FIG. 8 was invented (see Japanese Patent Gazette No. 2000-127033).

In the apparatus shown in FIG. 8, an upper end of a rotary shaft 302, which is directly driven by a direct drive (DD) motor 300, is connected to a polishing plate 304. A polishing cloth 306 is adhered on a surface of the polishing plate 304. A work piece 312 is adhered on an adhering block 310 of a carrier head 308. The carrier head 308 is provided to a lower end of a rotary shaft 316, which is directly rotated by a DD motor 314. A side face of the work piece 312 is pressed onto a polishing face of the polishing cloth 306 with a prescribed pressing force, so that the side face of the work piece 312 can be polished.

In the apparatus shown in FIG. 8, the polishing plate 304 and the carrier head 308 are directly rotated by the DD motors 300 and 314 without transmission means. Therefore, damaging and breaking the work piece 312 caused by vibrations and backlashes of gears can be prevented. Even thin work pieces can be properly polished. Note that, the polishing apparatus cannot simultaneously polish the both side faces of the work piece 312.

The apparatus shown in FIG. 8 has two rotary shafts 302 and 316 for rotating the polishing plate 304 and the carrier head 308. On the other hand, the apparatus shown in FIG. 6, which is capable of simultaneously polishing the both side faces of the work pieces, has four rotary shafts 217, 219, 221 and 223 for rotating the polishing plates 200 and 202 and the gears 204 and 206. Generally, DD motors are larger than ordinary electric motors. So if three or more rotary shafts are respectively driven by DD motors, the polishing apparatus must be large.

SUMMARY OF THE INVENTION

An object of the present invention is to provide a small polishing apparatus, which is capable of simultaneously polishing both side faces of a work piece and whose lower polishing plate, internal gear and sun gear are respectively driven by DD motors.

The inventor found to use DD motors having a fixed cylindrical member, which is located at a central part and whose one end face is opened, and a ring-shaped output member, which outputs torque and which is provided on the one end face side.

Further, the inventor found that a couple of the DD motors can be vertically arranged in a narrow space by piercing a rotary shaft, which is driven by the lower DD motor, through the cylindrical member of the upper DD motor, so that the inventor invented the polishing apparatus of the present invention.

Namely, a first basic structure of the polishing apparatus of the present invention comprises:

an upper polishing plate;

a lower polishing plate rotating in a prescribed direction;

a sun gear rotating in a prescribed direction;

an internal gear enclosing the sun gear and rotating in a prescribed direction;

a first rotary holding member rotatably holding the lower polishing plate;

a second rotary holding member rotatably holding the sun gear or the internal gear;

a carrier being provided between the upper polishing plate and the lower polishing plate and engaged with the sun gear and the internal gear, the carrier holding a work piece so as to simultaneously polish both side faces of the work piece with polishing faces of the upper polishing plate and the lower polishing plate; and DD motors for respectively rotating the lower polishing plate, the sun gear and the internal gear, each of the DD motors having a fixed cylindrical member, which is located at a central part and whose one end face is opened, and a ring-shaped output member, which outputs torque and which is provided on the one end face side, wherein the DD motors include:

a first DD motor having the ring-shaped output member, whose diameter is larger than an inner diameter of the cylindrical member, which rotates along a circumferential edge of the cylindrical member and which is directly connected to one of the rotary holding members; and a second DD motor being provided under the first DD motor, and one end of a rotary shaft, which is pierced through the cylindrical member of the first DD motor, is connected to the other rotary holding member, and the other end of the rotary shaft is directly connected to the ring-shaped output member of the second DD motor.

In the polishing apparatus, the second rotary holding member may rotatably hold the sun gear, a third rotary holding member may rotatably hold the internal gear, and one of the second and third rotary holding members, which is not connected to the first DD motor or the second DD motor, may be connected to a third DD motor by a belt. With this structure, height of the polishing apparatus can be limited, and vibrations and backlashes caused by gears can be prevented.

Preferably, the belt is a steel belt.

A second basic structure of the polishing apparatus of the present invention comprises:

an upper polishing plate;

a lower polishing plate rotating in a prescribed direction;

a sun gear rotating in a prescribed direction;

an internal gear enclosing the sun gear and rotating in a prescribed direction;

a first rotary holding member rotatably holding the lower polishing plate;

a second rotary holding member rotatably holding the sun gear;

a third rotary holding member rotating and holding the internal gear;

a carrier being provided between the upper polishing plate and the lower polishing plate and engaged with the sun gear and the internal gear, the carrier holding a work piece so as to simultaneously polish both side faces of the work piece with polishing faces of the upper polishing plate and the lower polishing plate; and DD motors for respectively rotating the lower polishing plate, the sun gear and the internal gear, each of the DD motors having a fixed cylindrical member, which is located at a central part and whose one end face is opened, and a ring-shaped output member, which outputs torque and which is provided on the one end face side, wherein the DD motors include:

a first DD motor having the ring-shaped output member, whose diameter is larger than an inner diameter of the cylindrical member, which rotates along a circumferential edge of the cylindrical member and which is directly connected to one of the rotary holding members;

a second DD motor being provided under the first DD motor, the second DD motor having the ring-shaped output member, whose diameter is larger than an inner diameter of the cylindrical member and which rotates along a circumferential edge of the cylindrical member; and a third DD motor being provided under the second DD motor, one end of a cylindrical rotary shaft, which is pierced through the cylindrical member of the first DD motor, is connected to one of the rotary holding members not connected to the first DD motor, and the other end of the cylindrical rotary shaft is directly connected to the ring-shaped output member of the second DD motor, and one end of a rotary shaft, which is pierced through the cylindrical member of the second DD motor and the cylindrical rotary shaft, is connected to the rest of the rotary holding members, and the other end of the rotary shaft is directly connected to the ring-shaped output member of the third DD motor.

In the both basic structures, a DD motor for rotating the upper polishing plate may be further employed. With this structure, vibrations and backlashes, which are caused by transmission gears, can be prevented.

In the both basic structures, an elevating unit for vertically moving the upper polishing plate with respect to the lower polishing plate may be further employed. With this structure, the work piece can be easily fed to and taken out from the carrier.

Further, rotational axes of the DD motors, which respectively rotate at least the lower polishing plate and the sun gear, may coincide each other. With this structure, rotational axes of at least the lower polishing plate and the sun gear can be easily coincided, so that polishing accuracy can be improved.

In the polishing apparatus of the present invention, the DD motor for rotating the lower polishing plate is connected to the rotary holding member for rotatably holding the lower polishing plate directly or with the rotary shaft. Therefore, the lower polishing plate, which is driven with large torque, can be smoothly rotated by the DD motor.

The rotary holding member for rotatably holding the internal gear or the sun gear is connected to the DD motor directly or with the rotary shaft.

By employing the DD motors, the lower polishing plate, the sun gear and the internal gear can be smoothly rotated, without vibrations and backlashes caused by gears, so that the apparatus can sufficiently polish thin work pieces.

Further, the first DD motor is directly connected to one of the rotary holding members, and the one end of the rotary shaft, which is pierced through the cylindrical member of the first DD motor, is connected to the other rotary holding member, and the other end of the rotary shaft is directly connected to the ring-shaped output member of the second DD motor.

Therefore, the first DD motor and the second DD motor can be vertically serially arranged, so that rotational axes of the lower polishing plate and the sun gear or internal gear can be easily coincided.

In the polishing apparatus of the present invention, polishing accuracy can be improved, spaces in the apparatus can be effectively used, and the apparatus can be small in size.

BRIEF DESCRIPTION OF THE DRAWINGS

Embodiments of the present invention will now be described by way of examples and with reference to the accompanying drawings, in which:

FIG. 2 is a perspective view of one of direct drive motors used in the apparatus shown in FIG. 1;

FIGS. 4A and 4B are explanation views of gears used in the apparatus shown in FIG. 3;

DETAILED DESCRIPTION OF THE EMBODIMENTS

Preferred embodiments of the present invention will now be described in detail with reference to the accompanying drawings.

Figure 1:
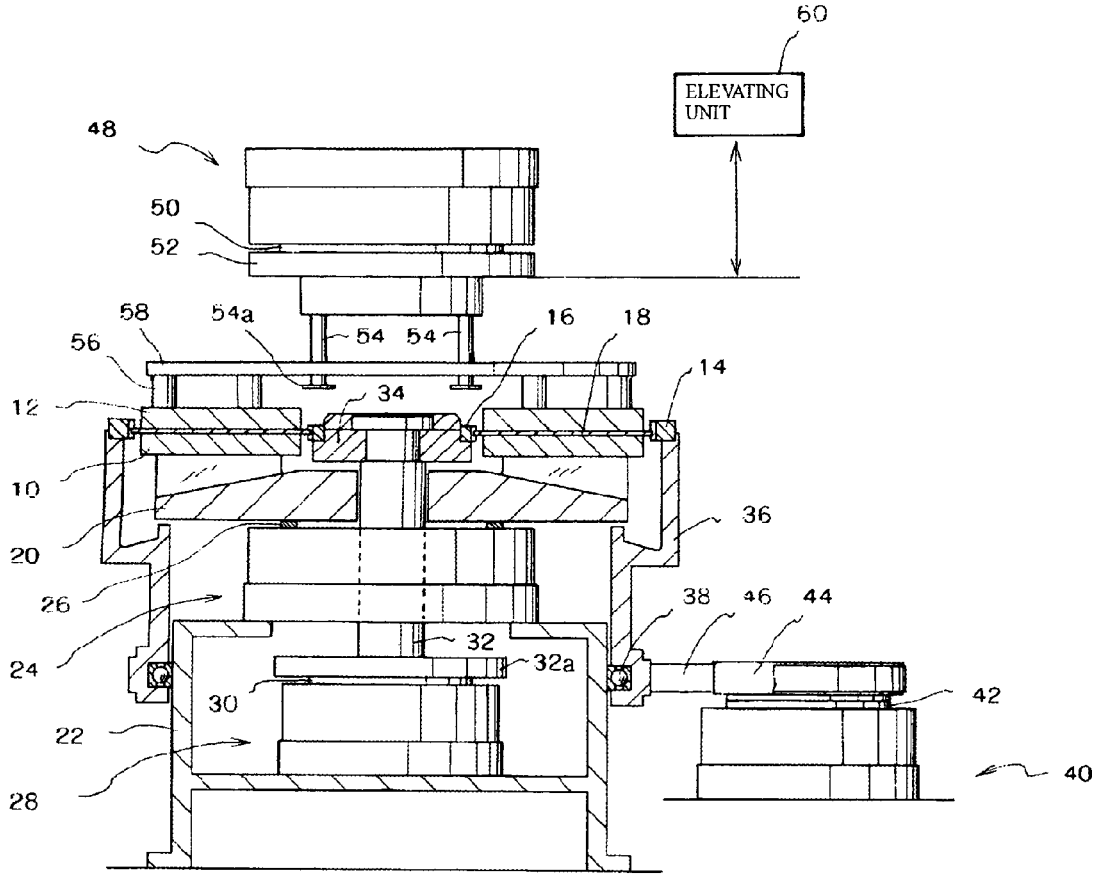
FIG. 1 is an explanation view of an embodiment of the polishing apparatus of the present invention.

An embodiment of the polishing apparatus of the present invention is shown in FIG. 1. The apparatus comprises a rotatable lower polishing plate 10, a rotatable upper polishing plate 12, and carriers 18, which are provided between the polishing plates 10 and 12 and which are driven by an internal gear 14 and a sun gear 16. Each of the carriers 18 has a plurality of through-holes (not shown), in which work pieces to be polished are respectively held. Both side faces of each work piece, which is held in the through-hole, can be simultaneously polished by the polishing plates 10 and 12.

The lower polishing plate 10 is mounted on a lower plate holder 20, which acts as a rotary holding member, and rotated together with the lower plate holder 20. The lower plate holder 20 is directly connected to a ring-shaped output member 26 of a first direct drive (DD) motor 24, which is mounted on a base 22.

The first DD motor 24 is shown in FIG. 2. A fixed cylindrical member 25 having an opened face 27 is provided at a center part of the motor 24. The ring-shaped output member 26, whose diameter is larger than an inner diameter of the cylindrical member 25 and which rotates along an outer circumferential edge of the opened face 27, is provided on the opened face 27. A plurality of attachment holes 26*a* are formed in the ring-shaped output member 26 so as to attach a driven member thereto.

A great torque is required to rotate the lower polishing plate 10. Thus, the ring-shaped output member 26 of the first DD motor 24 is directly connected to the lower plate holder 20, so that the lower polishing plate 10 can be smoothly rotated.

A second DD motor 28, whose structure is the same as that of the first DD motor 24 shown in FIG. 2, mounted on a part of the base 22, which is located under the first DD motor 24. A lower flange-shaped end 32*a* of a rotary shaft 32 is directly connected to a ring-shaped output member 30 of the second DD motor 28, a mid part of the rotary shaft 32 is pierced through the cylindrical member 25 of the first DD motor 24 (see FIG. 2) and a center through-hole of the lower plate holder 20, and an upper end of the rotary shaft 32 is connected to a rotary holding member 34, which rotatably holds the sun gear 16.

In the apparatus shown in FIG. 1, the first DD motor 24 for rotating the lower polishing plate 10 and the second DD motor 28 for rotating the sun gear 16 are vertically serially arranged, so that a space under the first DD motor 24 can be effectively used.

A rotary holding member 36, which rotatably holds the internal gear 14 rotating the carriers 18 with the sun gear 16, is capable of rotating along an outer circumferential face of the base 22 with a bearing 38, which is provided along the outer circumferential face of the base 22.

The rotary holding member 36 is connected to a pulley 44, which is located outside of the base 22 and which is directly connected to a ring-shaped output member 42 of a third DD motor 40 having a structure the same as that of the first DD motor 24 shown in FIG. 2, by a belt 46. With this structure, a torque of the third DD motor 40 can be transmitted to the rotary holding member 36, so that the internal gear 14 can be rotated together with the rotary holding member 36.

By using the belt 46, vibrations and backlashes caused by gears can be prevented. If the belt 46 is made of steel, e.g., stainless steel, slip between the belt 46 and the pulley 44 can be effectively prevented.

In the apparatus shown in FIG. 1, the upper polishing plate 12 is rotated by a fourth DD motor 48, which is located above the upper polishing plate 12 and whose structure is the same as that of the first DD motor 24 shown in FIG. 2. Note that, a rotational direction of the upper polishing plate 12 is opposite to that of the lower polishing plate 10.

A flange-shaped member 52, which is directly connected to a ring-shaped output member 50 of the fourth DD motor 48, is vertically moved by an elevating unit 60. A plurality of bolts 54 are screwed with the flange-shaped member 52. Flanges 54*a* are respectively formed at lower ends of the bolts 54.

The bolts 54 are pierced through a plate 58, which is connected to the upper polishing plate 12 by connecting members 56. When the flange-shaped member 52 is vertically moved by the elevating unit 60, the plate 58 and the upper polishing plate 12, which are held by the flanges 54*a* of the bolts 54, are moved in the vertical direction.

A rotational axis of the fourth DD motor 48 is coincided with rotational axes of the first DD motor 24 and the second DD motor 28, so that rotational axes of the polishing plates 10 and 12 and the sun gear 16 can be coincided.

A rotary holding member for rotatably holding the upper polishing plate 12 is constituted by the flange-shaped member 52, the bolts 54, the plate 58 and the connecting members 56.

In the apparatus shown in FIG. 1, the work pieces are polished by the steps of: moving the upper polishing plate 12 upward by the elevating unit 60; setting the work pieces in the through-holes (not shown) of the carriers 18 mounted on the lower polishing plate 10; moving the upper polishing plate 12 downward until reaching the carriers 18; applying prescribed loads to the work pieces; and driving the DD motors 24, 28, 40 and 48 to rotate the polishing plates 10 and 12, the internal gear 14 and the sun gear 16 in prescribed directions at prescribed rotational speeds.

The lower plate holder 20 holding the lower polishing plate 10, the flange-shaped member 52 constituting the rotary holding member of the upper polishing plate 12 and the rotary holding member 34 of the sun gear 16 are respectively connected to the DD motors 24, 28 and 48 directly or with rotary shafts. Therefore, the polishing plates 10 and 12 and the sun gear 16 can be smoothly rotated in the prescribed directions at prescribed rotational speeds.

On the other hand, the rotary holding member 36 of the internal gear 14 is connected to the third DD motor 40, without using a rotary shaft, by the belt 46. The internal gear 14 can be smoothly rotated with a torque smaller than that for rotating the lower polishing plate 10. Even if the internal gear 14 is connected to the third DD motor 40 by the belt 46, the third DD motor 40 can smoothly rotate the internal gear 14 in a prescribed direction at a prescribed speed.

While the polishing plates 10 and 12, the internal gear 14 and the sun gear 16 are rotated, slurry is applied to a polishing face of the lower polishing plate 10. The carriers 18 are spun and planetary-moved around the sun gear 16, so that the both side faces of the work pieces, which are held in the through-holes of the carriers 18, can be simultaneously polished by the polishing faces of the polishing plates 10 and 12.

No vibrations and backlashes caused by gears are generated in the polishing apparatus shown in FIG. 1 while polishing the work pieces. Therefore, the polishing plates 10 and 12, the internal gear 14 and the sun gear 16 can be smoothly rotated, so that even thin work pieces can be sufficiently polished.

In the apparatus, the DD motors 24, 28 and 48 are coaxially arranged, so that the rotational axes of the polishing plates 10 and 12 and the sun gear 16 can be easily coincided. Therefore, the work pieces can be highly precisely polished.

Upon completing the polishing, the DD motors 24, 28, 40 and 48 are stopped, then the elevating unit 60 moves the upper polishing plate 12 upward. The work pieces, whose both side faces have been polished, can be taken out from the carriers 18 mounted on the lower polishing plate 10.

Synchronous control of the DD motors 24, 28, 40 and 48 can be easily performed by a sequencer.

In the apparatus shown in FIG. 1, the rotary holding member 36 of the internal gear 14 is connected to the third DD motor 40, which is located outside of the base 22, by the belt 46.

Figure 3:
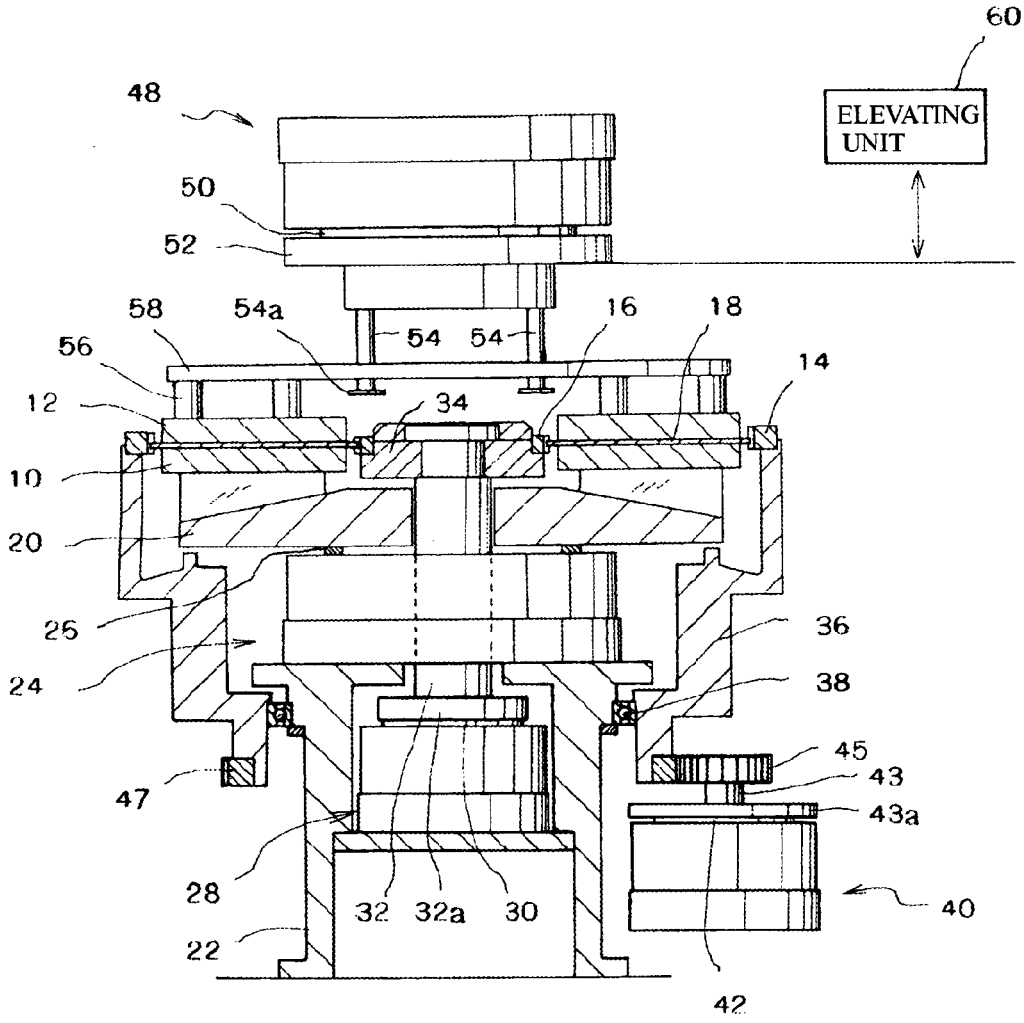
FIG. 3 is an explanation view of another embodiment of the polishing apparatus of the present invention.

If the belt 46 slips when the third DD motor 40 starts, the torque of the third DD motor 40 may be transmitted to the internal gear 14 by a gear 45, which is provided to one end of a rotary shaft 43 whose the other end is connected to a ring-shaped member 42 of the third DD motor 40, and a gear 47, which is provided on an outer circumferential face of the rotary holding member 36 of the internal gear 14, as shown in FIG. 3.

Note that, in the polishing apparatus shown in FIG. 3, the structural elements shown in FIG. 1 are assigned the same symbols, and explanation will be omitted.

In FIG. 3, vibrations and backlashes may be generated between the gears 45 and 47. However, even if vibrations and backlashes are generated between the gears 45 and 47, degrees of the vibrations and backlashes are small. Therefore, damage and break of the work pieces and the carriers 18 can be prevented.

To reduce the vibrations and backlashes generated between the gears 45 and 47, at least one of the gears 45 and 47 is made of, for example, plastic capable of absorbing vibrations.

Further, the backlashes caused by plays of the gears 45 and 47 based on machining accuracy. Therefore, the backlashes can be reduced by reducing the plays.

Thus, as shown in FIG. 4A, the gear 45 may be constituted by two gear pieces 45*a* and 45*b*, which are integrated by bolts 51.

Inner diameters of screw holes 53 of the gear piece 45*a*, in which the bolts 51 are inserted, is larger than outer diameters of the bolts 51. Therefore, positions of gear teeth 49*a* and 49*b* with respect to the gear pieces 45*a* and 45*b* can be adjusted and correctly fixed respectively.

As shown in FIG. 4B, each of gear teeth 49 of the gear 45 is constituted by the gear teeth 49*a* and 49*b*, whose positions have been adjusted and correctly fixed. When the gear 45 is engaged with the gear 47, the plays between the gears 45 and 47 can be minimized, so that the backlashes can be reduced.

In each of the polishing apparatuses shown in FIGS. 1 and 3, the rotary holding member 36 of the internal gear 14 is connected to the third DD motor 40, which is located outside of the base 22, by the belt 46 or the gears 45 and 47. With this structure, it is difficult to completely remove occurrence of the slip, vibrations and backlashes when the third DD motor 40 starts. However, the problem can be solved by a polishing apparatus shown in FIG. 5. Note that, structural elements explained in the former embodiments are assigned the same symbols, and explanation will be omitted.

Figure 5:
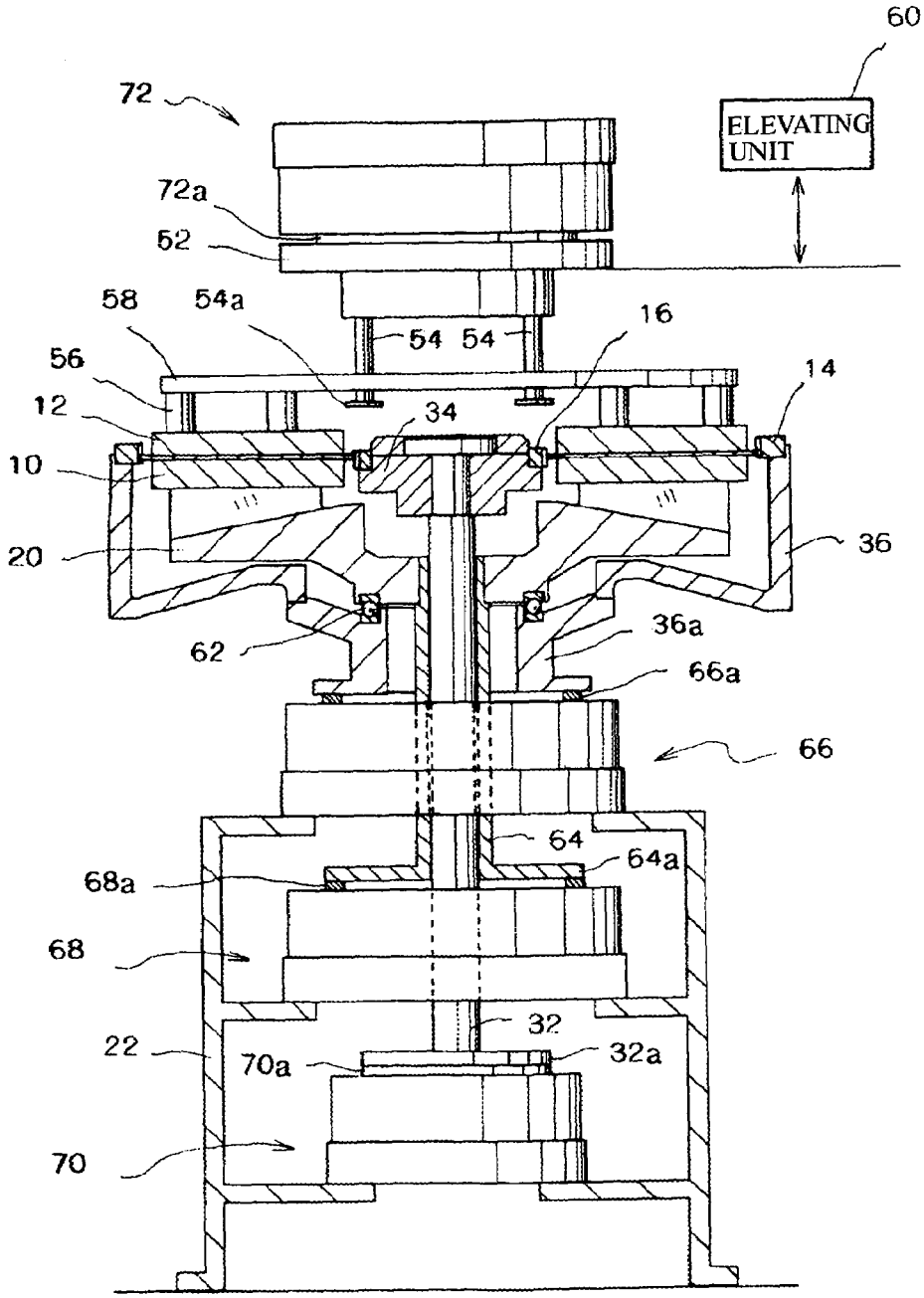
FIG. 5 is an explanation view of another embodiment of the polishing apparatus of the present invention.
Figure 6:
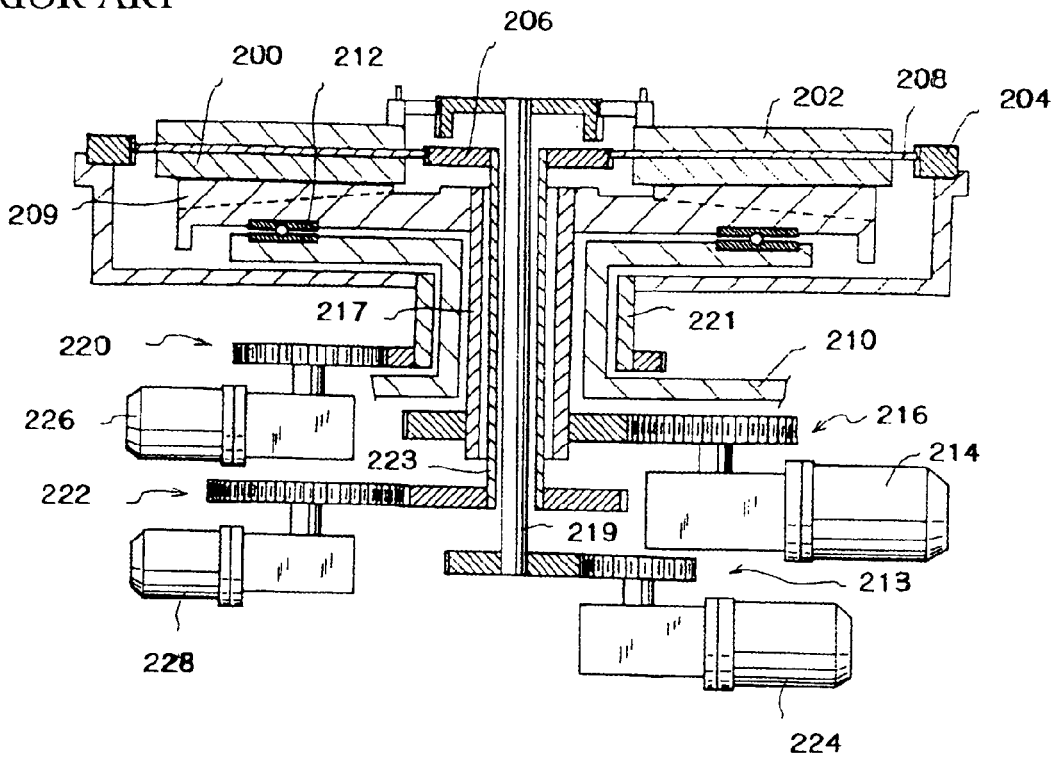
FIG.6 PRIOR ART
FIG. 6 is an explanation view of the conventional polishing apparatus.
Figure 7:
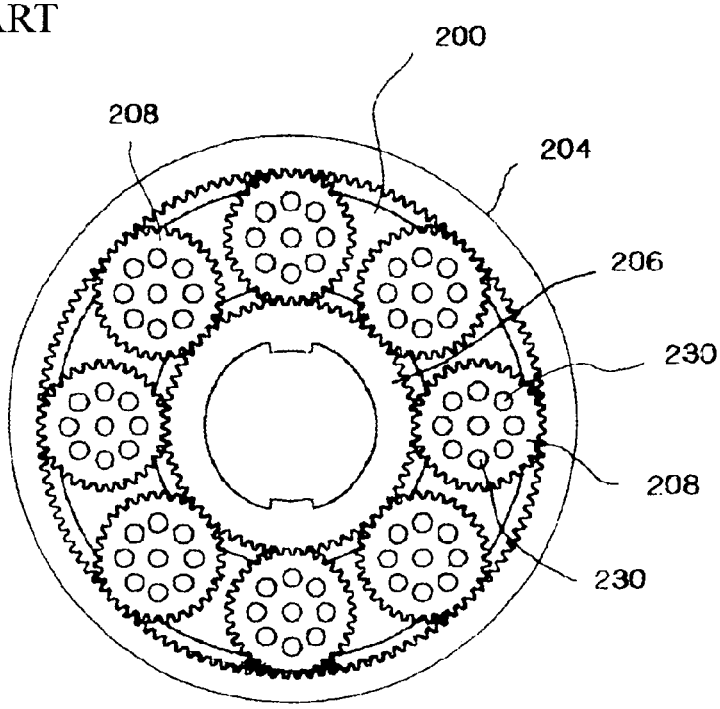
FIG.7 PRIOR ART
FIG. 7 is an explanation view of a carrier used in the apparatus shown in FIG. 6.
Figure 8:
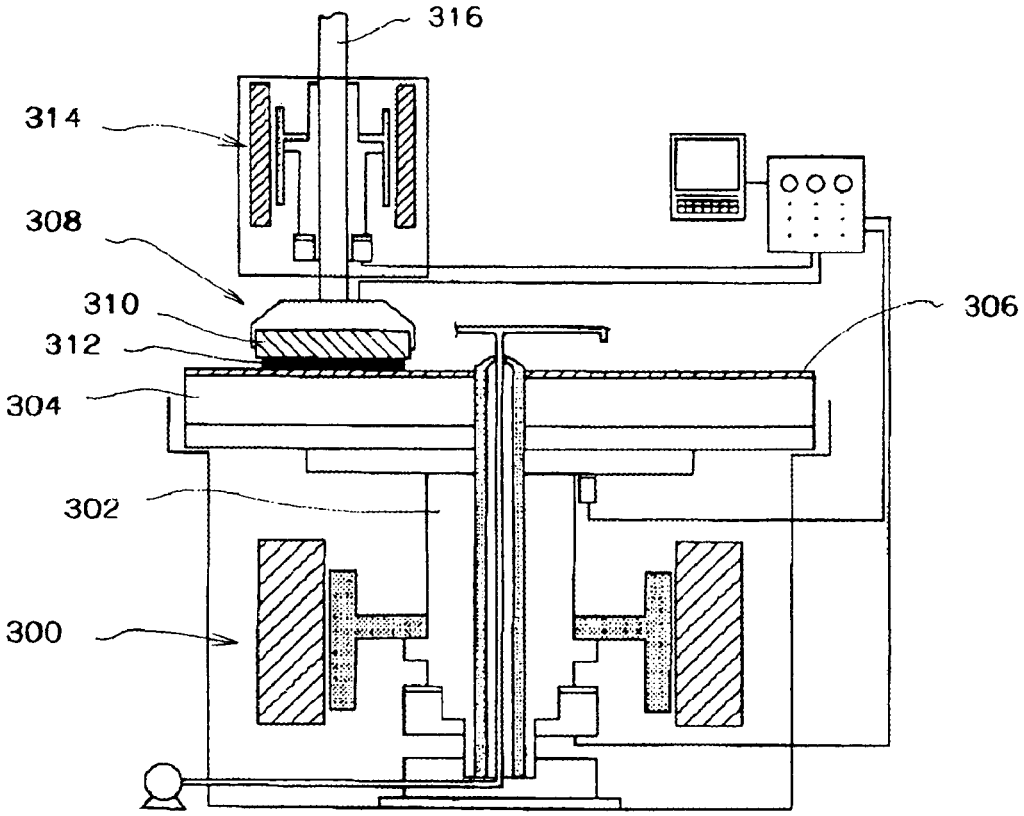
FIG.8 PRIOR ART
FIG. 8 is an explanation view of another conventional polishing apparatus.

In the apparatus shown in FIG. 5, a first DD motor 66, a second DD motor 68 and a third DD motor 70, which respectively rotate the lower polishing plate 10, the sun gear 16 and the internal gear 14 serially arranged in the base 22, are respectively connected to the rotary holding members directly or via shafts. Further, the upper polishing plate 12 is rotated by a fourth DD motor 72, which is provided above the upper polishing plate 12. Structures of the DD motors 66, 68, 70 and 72 are the same as that of the first DD motor 24 shown in FIG. 2. The DD motors 66, 68, 70 and 72 respectively have ring-shaped output members 66*a*, 68*a*, 70*a* and 72*a*.

In FIG. 5, a base part 36*a* of the rotary holding members 36, which rotates with holding the internal gear 14, is directly connected to the ring-shaped output member 66*a* of the first DD motor 66, which is mounted on the uppermost part of the base 22.

The lower plate holder 20 is rotatably mounted on the base part 36*a* of the rotary holding members 36 with a bearing 62. The second DD motor 68 is provided under the first DD motor 66 and mounted on a middle part of the base 22. A flange-shaped lower end 64*a* of a cylindrical rotary shaft 64 is directly connected to the ring-shaped output member 68*a* of the second DD motor 68, a mid part of the cylindrical rotary shaft 64 is pierced through the cylindrical member of the first DD motor 66, and an upper end of the cylindrical rotary shaft 64 is connected to the lower plate holder 20. With this structure, a torque of the second DD motor 68 can be transmitted to the lower plate holder 20 by the cylindrical rotary shaft 64, so that the lower plate holder 20 can be rotated.

The third DD motor 70 is provided under the second DD motor 68 and mounted on the lowermost part of the base 22. A flange-shaped lower end 32*a* of the rotary shaft 32 is directly connected to the ring-shaped output member 70*a* of the third DD motor 70, a mid part of the rotary shaft 32 is pierced through the cylindrical member of the second DD motor 68 and the cylindrical rotary shaft 64, and an upper end of the rotary shaft 32 is connected to the rotary holding member 34 of the sun gear 16. With this structure, a torque of the third DD motor 70 can be transmitted to the rotary holding member 34 by the rotary shaft 32, so that the rotary holding member 34 can be rotated.

In FIG. 5, the lower plate holder 20 and the rotary holding members 34 and 36 are respectively connected to the DD motors directly or via the shafts. Unlike the above described apparatuses using the belt 46 and the gears 45 and 47, the apparatus shown in FIG. 5 is capable of solving the problems of the slip, vibrations and backlashes.

In the apparatus shown in FIG. 5, the polishing plates 10 and 12, the internal gear 14 and the sun gear 16 are respectively connected to the DD motors directly or via the shafts. Therefore, no transmission gears and reduction units are required.

With this structure, the polishing plates 10 and 12, the internal gear 14 and the sun gear 16 can be smoothly rotated without vibrations and backlashes of gears, so that even thin work pieces can be sufficiently polished.

Further, the DD motors 66, 68, 70 and 72 are coaxially arranged, so that the rotational axes of the polishing plates 10 and 12, the internal gear 14 and the sun gear 16 can be easily coincided. Therefore, the work pieces can be highly precisely polished.

In the polishing apparatus shown in FIG. 1, the third DD motor 40 for rotating the internal gear 14 is located outside of the base 22.

The required torque for rotating the sun gear 16 may be smaller than that for rotating the lower polishing plate 10. Thus, the second DD motor 28 for rotating the sun gear 16 may be located outside of the base 22, and the rotary holding member 34 of the sun gear 16 may be connected to the second DD motor 28 directly or via a belt or a shaft. In this case, the third DD motor 40 for rotating the internal gear 14 is provided in the base 22, and the torque of the third DD motor 40 is transmitted to the rotary holding member 36 of the internal gear 14 directly or via a shaft.

In the above described embodiments, the DD motors 24, 28, 40, 48, 66, 68, 70 and 72 respectively have the ring-shaped output members. But, a plate-shaped output member may be assembled in the DD motor, in which no rotary shaft is pierced through the fixed cylindrical member 25.

In each of the apparatuses shown in FIGS. 1 and 5, if the upper polishing plate 12 need not rotate, the fourth DD motor 48 or 72 may be omitted. The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing apparatus, comprising:

an upper polishing plate;

a lower polishing plate rotating in a prescribed direction;

a sun gear rotating in a prescribed direction;

an internal gear enclosing said sun gear and rotating in a prescribed direction;

a first rotary holding member rotatably holding said lower polishing plate;

a second rotary holding member rotatably holding said sun gear or said internal gear;

a carrier being provided between said upper polishing plate and said lower polishing plate and engaged with said sun gear and said internal gear, said carrier holding a work piece so as to simultaneously polish both side faces of the work piece with polishing faces of said upper polishing plate and said lower polishing plate; and direct drive motors for respectively rotating said lower polishing plate, said sun gear and said internal gear, each of said direct drive motors having a fixed cylindrical member, which is located at a central part and whose one end face is opened, and a ring-shaped output member, which outputs torque and which is provided on the one end face side, wherein said direct drive motors include:

a first direct drive motor having the ring-shaped output member, whose diameter is larger than an inner diameter of the cylindrical member, which rotates along a circumferential edge of the cylindrical member and which is directly connected to one of said rotary holding members; and a second direct drive motor being provided under said first direct drive motor, and one end of a rotary shaft, which is pierced through the cylindrical member of said first direct drive motor, is connected to the other rotary holding member, and the other end of the rotary shaft is directly connected to the ring-shaped output member of said second direct drive motor.

2. The polishing apparatus according to claim 1, wherein said second rotary holding member rotatably holds said sun gear, a third rotary holding member rotatably holds said internal gear, and one of said second and third rotary holding members, which is not connected to said first direct drive motor or said second direct drive motor, is connected to a third direct drive motor by a belt.

3. The polishing apparatus according to claim 2, wherein the belt is a steel belt.

4. The polishing apparatus according to claim 1, further comprising a direct drive motor for rotating said upper polishing plate.

5. The polishing apparatus according to claim 1, further comprising an elevating unit vertically moving said upper polishing plate with respect to said lower polishing plate.

6. The polishing apparatus according to claim 1, further comprising:

a direct drive motor for rotating said upper polishing plate; and an elevating unit vertically moving said upper polishing plate and said direct drive motor for rotating said upper polishing plate with respect to said lower polishing plate.

7. The polishing apparatus according to claim 1, wherein rotational axes of said direct drive motors, which respectively rotate said lower polishing plate and said sun gear, coincide each other.

8. The polishing apparatus according to claim 1, further comprising a direct drive motor for rotating said upper polishing plate, wherein rotational axes of said direct drive motors, which respectively rotate said upper polishing plate, said lower polishing plate and said sun gear, coincide each other.

9. A polishing apparatus, comprising:

an upper polishing plate;

a lower polishing plate rotating in a prescribed direction;

a sun gear rotating in a prescribed direction;

an internal gear enclosing said sun gear and rotating in a prescribed direction;

a first rotary holding member rotatably holding said lower polishing plate;

a second rotary holding member rotatably holding said sun gear;

a third rotary holding member rotating and holding said internal gear;

a carrier being provided between said upper polishing plate and said lower polishing plate and engaged with said sun gear and said internal gear, said carrier holding a work piece so as to simultaneously polish both side faces of the work piece with polishing faces of said upper polishing plate and said lower polishing plate; and direct drive motors for respectively rotating said lower polishing plate, said sun gear and said internal gear, each of said direct drive motors having a fixed cylindrical member, which is located at a central part and whose one end face is opened, and a ring-shaped output member, which outputs torque and which is provided on the one end face side, wherein said direct drive motors include:

a first direct drive motor having the ring-shaped output member, whose diameter is larger than an inner diameter of the cylindrical member, which rotates along a circumferential edge of the cylindrical member and which is directly connected to one of said rotary holding members;

a second direct drive motor being provided under said first direct drive motor, said second direct drive motor having the ring-shaped output member, whose diameter is larger than an inner diameter of the cylindrical member and which rotates along a circumferential edge of the cylindrical member; and a third direct drive motor being provided under said second direct drive motor, one end of a cylindrical rotary shaft, which is pierced through the cylindrical member of said first direct drive motor, is connected to one of said rotary holding members not connected to said first direct drive motor, and the other end of the cylindrical rotary shaft is directly connected to the ring-shaped output member of said second direct drive motor, and one end of a rotary shaft, which is pierced through the cylindrical member of said second direct drive motor and the cylindrical rotary shaft, is connected to the rest of said rotary holding members, and the other end of the rotary shaft is directly connected to the ring-shaped output member of said third direct drive motor.

10. The polishing apparatus according to claim 9, further comprising a direct drive motor for rotating said upper polishing plate.

11. The polishing apparatus according to claim 9, further comprising an elevating unit vertically moving said upper polishing plate with respect to said lower polishing plate.

12. The polishing apparatus according to claim 9, further comprising:

a direct drive motor for rotating said upper polishing plate; and an elevating unit vertically moving said upper polishing plate and said direct drive motor for rotating said upper polishing plate with respect to said lower polishing plate.

13. The polishing apparatus according to claim 9, wherein rotational axes of said direct drive motors, which respectively rotate said lower polishing plate, said sun gear and said internal gear, coincide each other.

14. The polishing apparatus according to claim 9, further comprising a direct drive motor for rotating said upper polishing plate, wherein rotational axes of said direct drive motors, which respectively rotate said upper polishing plate, said lower polishing plate, said sun gear and said internal gear, coincide each other.

* * * * *